US007479859B2

(12) United States Patent
Gerber

(10) Patent No.: US 7,479,859 B2
(45) Date of Patent: Jan. 20, 2009

(54) APPARATUS AND METHOD FOR PROCESSING MATERIAL IN A MAGNETIC VORTEX

(76) Inventor: Jack Gerber, 60 Watson Ave., Apartment 1H, Elizabeth, NJ (US) 07202

( * ) Notice: Subject to any disclaimer, the term of this patent is extended or adjusted under 35 U.S.C. 154(b) by 574 days.

(21) Appl. No.: 11/370,089

(22) Filed: Mar. 8, 2006

(65) Prior Publication Data

US 2007/0210886 A1 Sep. 13, 2007

(51) Int. Cl.

| | |
|---|---|
| ***H01F 7/02*** | (2006.01) |
| ***C25B 5/00*** | (2006.01) |
| ***B03C 1/00*** | (2006.01) |
| ***B01F 13/08*** | (2006.01) |

(52) U.S. Cl. ..... 335/296; 335/306; 204/155; 209/217; 366/273; 366/274

(58) Field of Classification Search ..... 335/296–298, 335/302–306; 204/155–156, 557; 209/39, 209/40, 217–222, 368; 366/273, 274
See application file for complete search history.

(56) References Cited

U.S. PATENT DOCUMENTS

| | | | |
|---|---|---|---|
| 3,470,828 | A | 10/1969 | Powell, Jr. et al. |
| 4,168,182 | A | 9/1979 | Rossmann et al. |
| 4,307,668 | A | 12/1981 | Vinson |
| 4,378,209 | A | 3/1983 | Berge et al. |
| 4,473,415 | A | 9/1984 | Ochiai et al. |
| 4,521,854 | A | 6/1985 | Rhim et al. |
| 4,528,481 | A | 7/1985 | Becker et al. |
| 4,615,760 | A | 10/1986 | Dressler |
| 4,646,651 | A | 3/1987 | Yamamura et al. |
| 4,677,642 | A | 6/1987 | Robinson et al. |
| 4,704,258 | A | 11/1987 | Hemmerdinger et al. |
| 4,816,965 | A | 3/1989 | Drits |
| 4,960,572 | A | 10/1990 | Littke et al. |
| 5,106,592 | A | 4/1992 | Stapelmann et al. |
| 5,139,605 | A | 8/1992 | Littke et al. |

(Continued)

OTHER PUBLICATIONS

Michael Faraday, Experimental Researches in Electricity, 1854, vol. III, pp. 553-558, Dover Publications, New York.

(Continued)

*Primary Examiner*—Ramon M Barrera

(57) ABSTRACT

An apparatus and method in which three or more permanent or electromagnets are mounted in a support structure on rotatable axes in spaced relationship to each other such that the magnetic lines of force of the same magnetic polarity continuously repel each other to generate a field in "opolarity." The magnets are focused to a generally central spherical shell-like space and upon continuous synchronous rotation generate a magnetic vortex. Magnetic materials or materials that can be made susceptible to the effects of a magnetic field are placed in a material processing portion of a material containment vessel that is positioned in the magnetic vortex where upon continuous synchronous rotation of the magnets, the material is subjected to the quantum and wave mechanical effects of the magnetic vortex so as to be compacted, aggregated, separated, reaggregated, manipulated, tumbled, and levitated and in the process the physical, chemical, and magnetic properties and chemical composition of the material is changed. This process has special significance to the semiconductor, alloy, crystal growing, and pharmaceutical industries. When the rotation of the magnets is stopped the material is levitated as if in a gravity-free or micro-gravity environment.

47 Claims, 7 Drawing Sheets

U.S. PATENT DOCUMENTS 5,266,284 A 11/1993 Heilig et al.
5,429,341 A 7/1995 Barczy et al.
5,529,391 A * 6/1996 Kindman et al. ..... 366/145
5,531,185 A 7/1996 Asano et al.
5,611,139 A 3/1997 Chelluri et al.
5,689,797 A 11/1997 Chelluri et al.
5,837,055 A 11/1998 Yamada et al.
5,935,346 A 8/1999 Couderchon et al.
5,961,213 A * 10/1999 Tsuyuki et al. ..... 366/273
5,985,535 A * 11/1999 Urabe ..... 430/569
6,217,672 B1 4/2001 Zhang
6,455,815 B1 9/2002 Helgaard et al.
6,467,946 B1 * 10/2002 Gebrian ..... 366/273
6,596,076 B1 7/2003 Wakayama

OTHER PUBLICATIONS

Michael Faraday, Faraday's Diary: Being the Various Philosophical Notes of Experimental Investigations by Michael Faraday, 1932 vol. I, Apr. 6, 1821, pp. 45-46, vol. IV, Frontpiece, G. Belland Sons, London.

James Clerk Maxwell, "On Physical Lines of Force," Scientific Papers of James Clerk Maxwell, 1965, 467, Dover Publications, New York.

* cited by examiner

APPARATUS AND METHOD FOR PROCESSING MATERIAL IN A MAGNETIC VORTEX

BACKGROUND OF THE INVENTION

1. Field of the Invention

This invention relates to an apparatus and method for processing materials by interaction of the same with a magnetic field or fields constituting a magnetic vortex.

Magnetic devices including permanent magnets and electromagnets have for many years been used to construct machines that utilize the attraction and repulsion of magnetic poles to cause motion of elements affixed to or placed near such magnets. Such machines include rotary motors, linear motors, and magnetic levitation systems for trains and the like. Such devices have also been used to construct machines that generate magnetic fields for containment or acceleration of charged particles, for example in cyclotrons, linear accelerators, and Tokamak type nuclear fusion reactors.

However, there has been little work done in the direct application of permanent magnets and electromagnets to materials processing. Accordingly, an object of the present invention is to provide an apparatus and method utilizing permanent and/or electromagnets to process materials ("magnetically susceptible" materials) by the effects of a magnetic field.

Another object of the present invention is to utilize the interaction of magnetic poles of the same magnetic polarity, i.e., a magnetic field in "opolarity," to process such materials.

Another object of the present invention is to utilize the effects of a concentrated magnetic field in opolarity to process materials by inducing quantum and wave mechanical effects upon materials so as to change their physical and chemical properties and to change their chemical composition and to induce magnetic properties into such materials.

Another object of the present invention is to utilize the effects of a magnetic field in opolarity to generate a "magnetic vortex" in which such materials are compacted, aggregated, separated, reaggregated, manipulated, tumbled, and levitated during material processing.

2. Description of the Prior Art

Opposite magnetic poles attract each other and like magnetic poles repel each other. Michael Faraday observed that a magnetic material placed in the space substantially equidistant between the ends of two opposed bar magnets having the same magnetic polarity (that is, poles that repelled each other) seemed to be unaffected by the magnetic field between the two opposed ends.

Faraday conducted essentially the same experiment with four permanent bar magnets in which the ends of the same magnetic polarity were placed at each of the respective sides of an open-ended square fabricated from cardboard with like poles adjacent the square into the center of which he lowered a small ball of bismuth (a diamagnetic material) attached to the end of a string. He had previously made the magnetic "lines of force" of this arrangement visible by placing a piece of stiff paper over the top of the square and surrounding magnets and then sprinkling iron filings onto the stiff paper. By lightly tapping the paper to agitate the iron filings, the filings aligned themselves along the respective magnetic "lines of force." Faraday found no effect on the suspended ball. He also placed six equally sized bar electromagnets the ends of which were of the same magnetic polarity around what constituted a cube into the center of which he again lowered various items in order to determine the presence of any magnetic effects and he was unable to determine any effect on the material so placed. See *Faraday's Diary; Being the Various Philosophical Notes of Experimental Investigations by Michael Faraday*, Seven Volumes, London, laboratory notes of Sep. 2, 11, 13, 15, and Dec. 14, 19, 1854, 6 *Diary* 288, 299, 316, 323, 328, 350, 356: G. Bell and Sons, 1932, the same in *Experimental Researches in Electricity*, New York: Dover Publications, 1965, entry 3341 at page 553 and following. Thus it has been known since classical antiquity that when like magnetic poles of the same magnetic polarity are placed opposite to each other there exists a region between the poles where the magnetic field intensity, i.e., detectible attractive forces, is essentially zero whereas the repulsive forces are at a maximum. However, prior to the present invention there has been no application of this phenomenon, or of related phenomena, to the processing of materials.

SUMMARY OF THE INVENTION

According to one aspect of the invention, apparatus is provided for processing magnetic materials that are inherently amenable to the effects of magnetic lines of force and materials that can be made susceptible to the effects of magnetic lines of force. That apparatus includes a base and operatively connected support structure, at least three magnets for generating magnetic lines of force, a material containment vessel into which the material is placed and processed, and means to continuously rotate the magnets in such a spatially synchronized way so as to generate a magnetic vortex that traverses the containment vessel and to thereby process the material therein.

The orientation and movement of the magnets is such that material placed within a material processing space of the material containment vessel that communicates with a central space of the magnetic vortex is compacted, aggregated, separated, reaggregated, manipulated, tumbled, and levitated into, across, and around the central space by the rotation of the magnets.

According to another aspect of the invention a method is provided for processing magnetic materials that are inherently amenable to the effects of a magnetic field and materials that can be made susceptible to the effects of a magnetic field by disposing three or more magnets in opposing polarity so that adjacent poles of the magnets tend to repel each other. The three magnets are rotated with respect to each other in such a way that the magnetic lines of force extending from the magnets describe rotating ring-like paths that traverse a generally central shell-like space such that upon spaced relationship with each other and upon rotation the magnets produce a "magnetic vortex" in the shell-like space. At least a portion of the material to be processed is placed in the magnetic vortex so that the material is repetitively acted upon by the magnetic vortex to cause the material to be compacted, aggregated, separated, reaggregated, manipulated, tumbled, and levitated in the magnetic vortex. The magnetic lines of force thereupon induce quantum and wave mechanical and magnetic effects into the material so as to change the material's physical and chemical properties and chemical composition as well as to induce particular arrangements of the material such as juxtaposed parallel helices with connecting strands of material akin to the helices of the DNA molecule as well as to convolute such helices upon themselves into essentially spherical aggregates similar to the nucleus of biological cellular material.

BRIEF DESCRIPTION OF THE DRAWINGS

The manner in which the objects, features, and advantages of the present invention are attained will be apparent from the following description when considered in view of the drawings, wherein.

DETAILED DESCRIPTION

Figure 1:
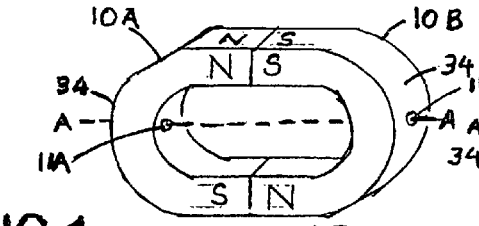
FIG. 1 is an isometric view of two horseshoe-shaped or U-shaped permanent magnets arranged in series-aiding polarity in contact with each other, that is, in a North Pole ("N")-South Pole ("S") or N-S orientation.

According to a preferred embodiment of the invention, a generally ring-shaped pattern of magnetic lines of force of the same magnetic polarity is generated by positioning a plurality of magnets with poles of the same magnetic polarity juxtaposed to each other in series-opposing or an "opolarity" relationship with each other. The magnets are preferably oriented in a coplanar relationship. The magnets are synchronously coordinately rotated so that a configuration of rotating magnetic lines of force of the same magnetic polarity is focused and concentrated into a generally spherical shell-like space between the magnets. This rotating magnetic field configuration is sometimes referred to herein as a "magnetic vortex."

Substances comprising magnetic material or materials that can be made susceptible to the effects of magnetic lines of force are introduced into a portion of the magnetic vortex where they are repetitively acted upon by the magnetic vortex so that the materials are processed in a desired manner.

Such processing can be used to aggregate, separate, reaggregate, manipulate, tumble, and levitate the material and as a result of the action of the repeated cycles of moving magnetic lines of force upon the material the material is subjected to the quantum and wave mechanical and magnetic effects of the magnetic lines of force so as to change the physical, chemical, and magnetic properties and chemical composition of the material and to induce particular arrangements of the material such as to form juxtaposed helices of extended length with strands of material bridging the space between the helices that upon continued rotation within the magnetic vortex consolidate and convolute themselves into essentially spherical aggregates with an internal helical structure akin to biological nuclear matter.

Magnetic Fields of Opposing Polarity ("Opolarity")

A magnetic field of opposing polarity, referred to herein as a magnetic field in "opolarity," can be generated by placing the north and south poles of a permanent horseshoe magnet opposite the north and south poles respectively of a similar permanent horseshoe magnet so that the poles of one magnet repel identical poles of the other magnet. See FIG. 2 for example. When this is done, magnetic lines of force associated with one magnet are juxtaposed opposite to the same magnetic lines of force associated with the other magnet in a space between the magnets and the magnetic field intensity or magnetomotive force in the space where the magnetic lines of force associated with one magnet come close to and oppose the magnetic lines of force associated with the other magnet generate forces that are capable of being applied to material that has been placed in the interposed space. Upon synchronous coordinated rotation of the magnets and their respective magnetic lines of force these forces push parts of the material together and pull parts of the material apart in repeated cycles so as to act upon such material especially near the space that is essentially equidistant from the opposing magnetic poles in the case of magnets of equal size and strength.

Additional Discussion of Magnetic Fields in Opolarity

In FIG. 1, a pair of matching permanent horseshoe magnets 10A and 10B have their respective faces or poles N, S and N, S, placed in contact with each other and so marked by capital letters arbitrarily assigned to the respective poles such that the magnets attract each other as is well known to those familiar with the magnetic arts and historically designated as a N[orth]-S[outh]-N-S orientation. The arches 34 of horseshoe magnets 10A and 10B have been fabricated with bores 11A through the respective arches midway between the respective side surfaces and respective ends of the magnets on an axial alignment A-A between the two poles of the magnets.

Figure 2:
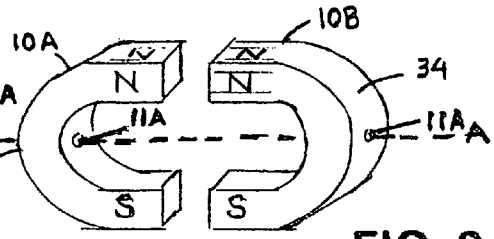
FIG. 2 is an isometric view of the magnets shown in FIG. 1 arranged in a series-opposing or "opolarity" juxtaposed orientation, that is, in a N-N-S-S orientation that results from a 180° rotation of one of the magnets shown in FIG. 1 about the axis A-A therein.

FIG. 2 shows magnets 10A and 10B separated and one magnet realigned 180° on the axis A-A through bores 11A such that the respective poles repel each other N,N,S,S, also well known to those skilled in the magnetic arts.

Figure 3:
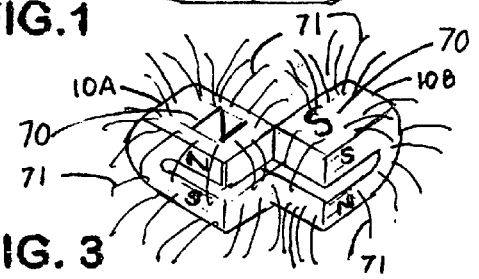
FIG. 3 is an isometric view of the magnets shown in FIG. 1 arranged in series-aiding polarity with their poles positioned in a 90° orientation to each other and showing the magnetic lines of force (as revealed by the alignment of fine iron filings in the manner of Faraday) extending from and to the side surfaces of the magnets.

FIG. 3 shows magnets 10A and 10B separated by a gap between their respective poles that have been oriented at a 90° angle to each other showing the magnetic lines of force 71 (made visible by sprinkling fine iron filings onto a transparent sheet (not shown) and then lightly tapping the sheet in the manner of Faraday to make the magnetic lines of force visible) that emanate from the respective north poles and south poles and spaces 70 from which said iron filings have been expelled by the convergence of magnetic lines of force of the same polarity as a field in "opolarity."

Figure 4:
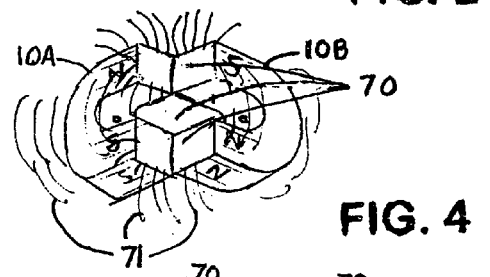
FIG. 4 is an isometric view of the magnets shown in FIG. 3 showing the magnetic lines of force extending from and to the poles of the magnets.

FIG. 4 shows the magnets 10A and 10B of FIG. 3 placed in an essentially vertical position such that the poles of the magnets point upwards in which the magnetic lines of force 71 are seen to emanate from or enter the respective poles of magnets 10A and 10B and respective spaces 70 in opolarity.

Figure 5:
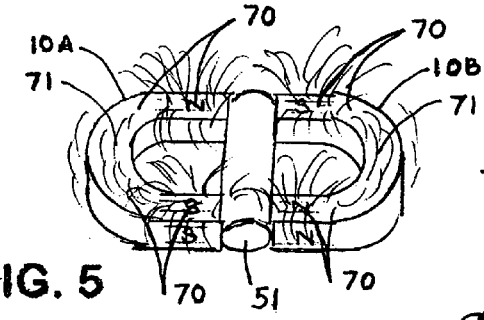
FIG. 5 is an isometric view of the magnets shown in FIG. 1 arranged in series-aiding polarity with a nonmagnetic spacer placed between them and showing the magnetic lines of force extending from and to the side surfaces of the magnets.

FIG. 5 shows the magnets 10A and 10B of FIG. 1 in which a nonmagnetic spacer 51 has been placed between the respective poles of the magnets. The corresponding magnetic lines of force 71 in such a configuration exhibit space of opolarity 70 from which the iron filings have been expelled.

Figure 6:
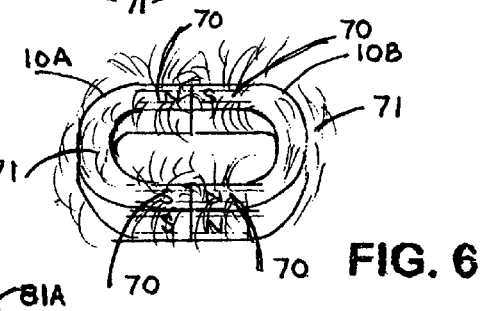
FIG. 6 is an isometric view of the magnets shown in FIG. 5 from which the spacer has been removed to permit contact between the respective poles, that is, in the manner shown in FIG. 1 and showing the magnetic lines of force extending between the side surfaces of the magnets.

In FIG. 6 the arrangement of FIG. 5 has been modified by removing the spacer 51 and bringing the magnets in contact with each other as shown in FIG. 1. The magnetic lines of force 71 are seen to extend over the junction of the respective poles of magnets 10A and 10B and the presence of spaces 70 is seen indicating fields in opolarity.

Figure 7:
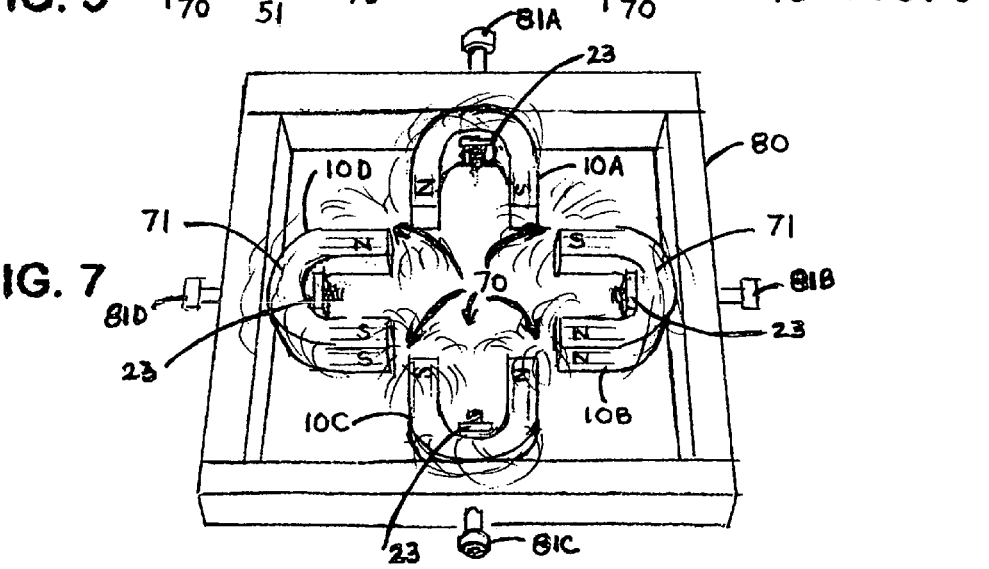
FIG. 7 is an isometric view of four horseshoe permanent magnets in coplanar series-opposing or opolarity N-N-S-S-N-N-S-S orientation fixedly attached to a peripheral support structure and showing the magnetic lines of force extending from and to the magnet poles and other surfaces and the absence of iron filings in the generally central space from which such filings have been forcibly expelled by the opposing lines of force of the same magnetic polarity graphically shown by interlineated arrows.

FIG. 7 shows an arrangement of four horseshoe magnets 10A, 10B, 10C, and 10D (magnets 10A and 10B being the same magnets as those shown in FIGS. 1 through 6) that are fixedly aligned in opolarity, that is, with the north pole of each magnet adjacent to the north pole of another magnet and the south pole of each magnet adjacent to the south pole of another magnet. The magnets are attached to a rigid peripheral support structure 80 by holding bolts 81A, 81B, 81C, and 81D and nuts 23. The corresponding magnetic lines of force 71 are shown as is the enlarged space 70 as a field in opolarity equivalent to that of the spaces 70 in FIGS. 3, 4, 5, and 6.

Figure 8:
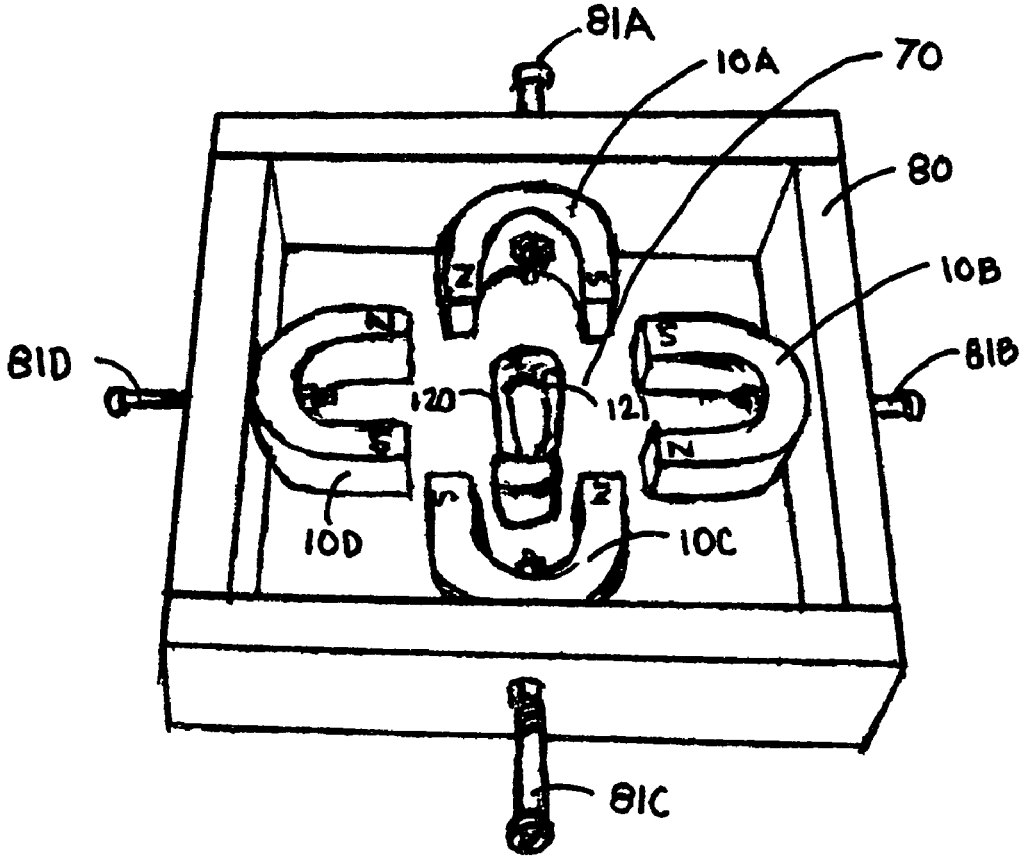
FIG. 8 is an isometric view of the peripheral support structure and magnets of FIG. 7 into the center of which a 4-watt incandescent light bulb has been placed to demonstrate the quantum and wave mechanical effects of the [invisible] magnetic lines of force of the magnetic field in opolarity on the visible electromagnetic radiation ("light" [photons]) emitted by the energized filament of the bulb.

FIG. 8 is the rigid peripheral support structure 80 and magnets 10A, 10B, 10C, and 10D of FIG. 7 that empirically demonstrates the quantum and wave mechanical effects of the magnetic field in opolarity 70 in the generally central space in which the opposing magnetic lines of force are directed to a 4-watt incandescent light bulb 120 and to its filament 121 therein that has been placed in the generally central space 70. Faraday demonstrated the relationship between "light" [photons] and the magnetic field by directing a beam of light focused by a lens through the poles of his great horseshoe magnet to which he attached extensions that essentially came to a point with a small gap therebetween through which he directed the beam and thereby detected an advanced polarization of the beam as a result of the rotation induced by the magnets. Maxwell hypothecated the equivalence between light as an electromagnetic phenomenon and magnetism because of their common velocity. Planck discovered and Einstein articulated the quantum mechanical relationship between light and electricity through the photoelectric effect. DeBroglie and Schrödinger articulated the phenomena in terms of wave mechanics. FIG. 8 demonstrates the direct quantum and wave mechanical effect of the magnetic field in opolarity when the magnetic lines of force are focused to a common locus of convergence in the generally central space 70 into which the incandescent bulb 120 has been placed. When the filament 121 of the unlit bulb 120 is placed into the generally central space 70 there is no noticeable effect on the filament. When the bulb is lit, filament 121 will instantaneously begin to vibrate with sufficient increased agitation and luminosity such that the filament in most cases will "burn out" virtually instantaneously or if not it will then continue to vibrate at a substantially increased luminosity. The same effect can be achieved by lowering the peripheral support structure over a bulb that has already been lit.

DESCRIPTION OF THE PREFERRED EMBODIMENT

Figure 9:
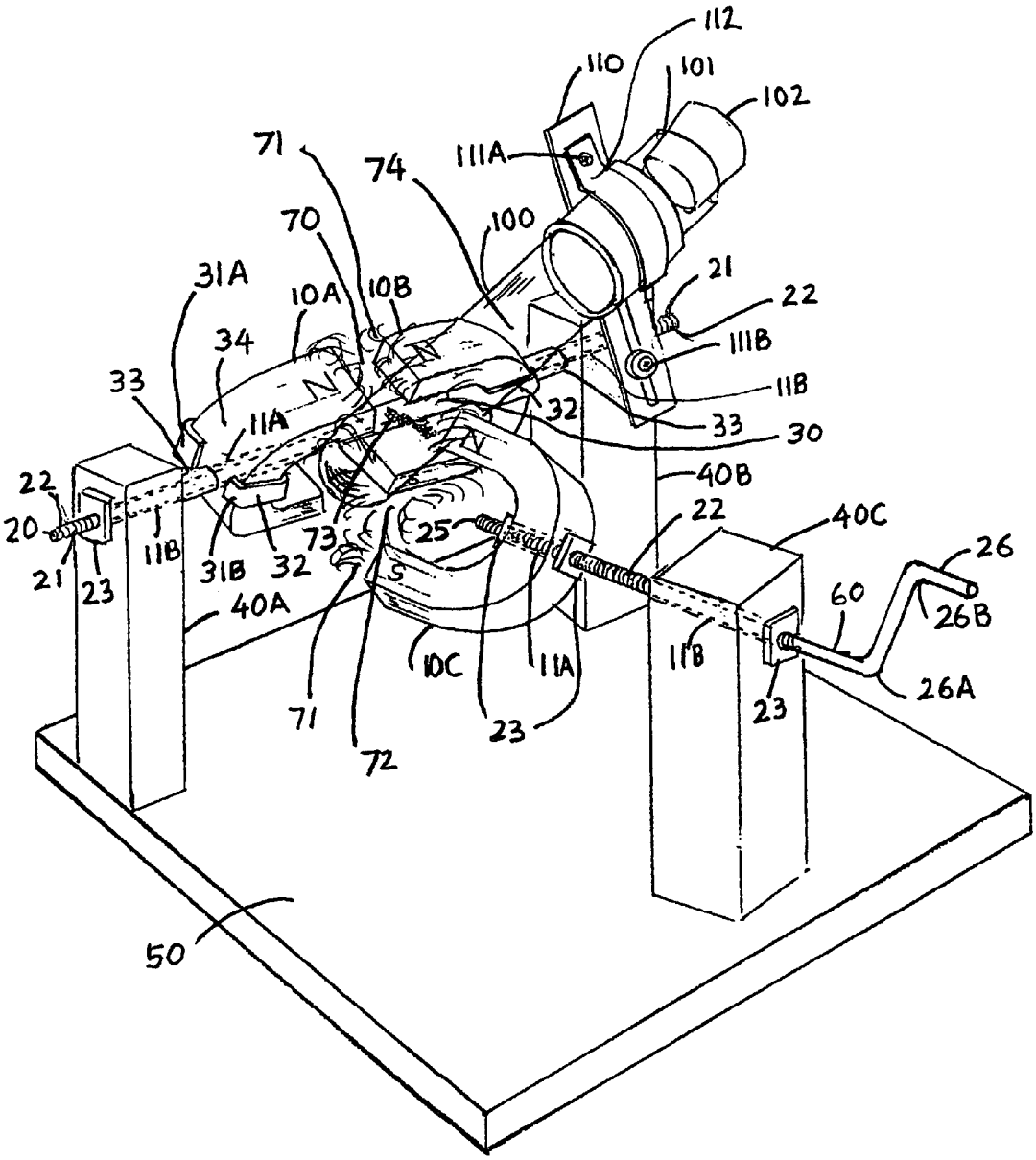
FIG. 9 is an isometric view of a preferred embodiment of the apparatus for processing material in a magnetic vortex showing material that has been processed into two adjacent helices and levitated across the diameter of a material containment vessel.

As shown in FIG. 9, the above referenced two substantially identical permanent horseshoe magnets 10A and 10B are arranged in opolarity, each having a bore 11A through the arches 34 of the magnets midway between the poles conventionally designated throughout the within specifications respectively as [N]orth, [S]outh and [N]orth, [S]outh thereof, and longitudinal axle 20 extending through bores 11A in magnets 10A and 10B and further extending through bores 11B of vertical supports 40A and 40B. The respective ends 21 of longitudinal axle 20 have been fabricated with threads 22 to allow them to threadably engage vertical supports 40A and 40B and to be fixedly attached to said vertical supports by nuts 23. Vertical supports 40A and 40B are rigidly attached to base support 50.

A concentric tubular sleeve 30 surrounds longitudinal axle 20 in the space between magnets 10A and 10B to keep them a fixed distance apart. The inside diameter of tubular sleeve 30 is somewhat larger than the outside diameter of longitudinal axle 20 so as to allow free rotation of tubular sleeve 30 around longitudinal axle 20 with magnets 10A and 10B affixed to the tubular sleeve. The ends 32 of tubular sleeve 30 have been split in two along the same lengthwise axis a sufficient length so as to be able to be wrapped around the arches 34 of magnets 10A and 10B and to be flattened into corresponding opposing tabs 31A and 31B. The tabs 31A and 31B are bent around the external side surfaces of arches 34 of magnets 10A and 10B to hold magnets 10A and 10B in fixed opolarity with each other during rotation around longitudinal axle 20.

Tubular spacers 33 are fabricated from the same tubing as tubular sleeve 30 and are placed in the space between the outside surfaces of arches 34 of magnets 10A and 10B and inwardly facing surfaces of vertical supports 40A and 40B to fixedly position magnets 10A and 10B symmetrically on longitudinal axle 20 between vertical supports 40A and 40B and to allow free rotation of magnets 10A and 10B around longitudinal axle 20.

A rotatable transverse axle 60 oriented somewhat less than perpendicular to longitudinal axle 20 extends through a bore 11B in a third vertical support 40C and has one end 25 fabricated with threads 22 extending through a bore 11A and fixedly secured to a third horseshoe magnet 10C with nuts 23. The north and south poles of the third magnet 10C face the first and second magnets 10A and 10B.

Transverse axle 60 is aligned between approximately 70° and 85° perpendicularly to longitudinal axle 20 at approximately the midpoint between vertical supports 40A and 40B. The magnets are positioned so that the space 70 between magnets 10A and 10B that are rotatably mounted on longitudinal axle 20 and magnet 10C that is attached to transverse axle 60 will constitute a material processing space for a material containment vessel 100.

Figure 12:
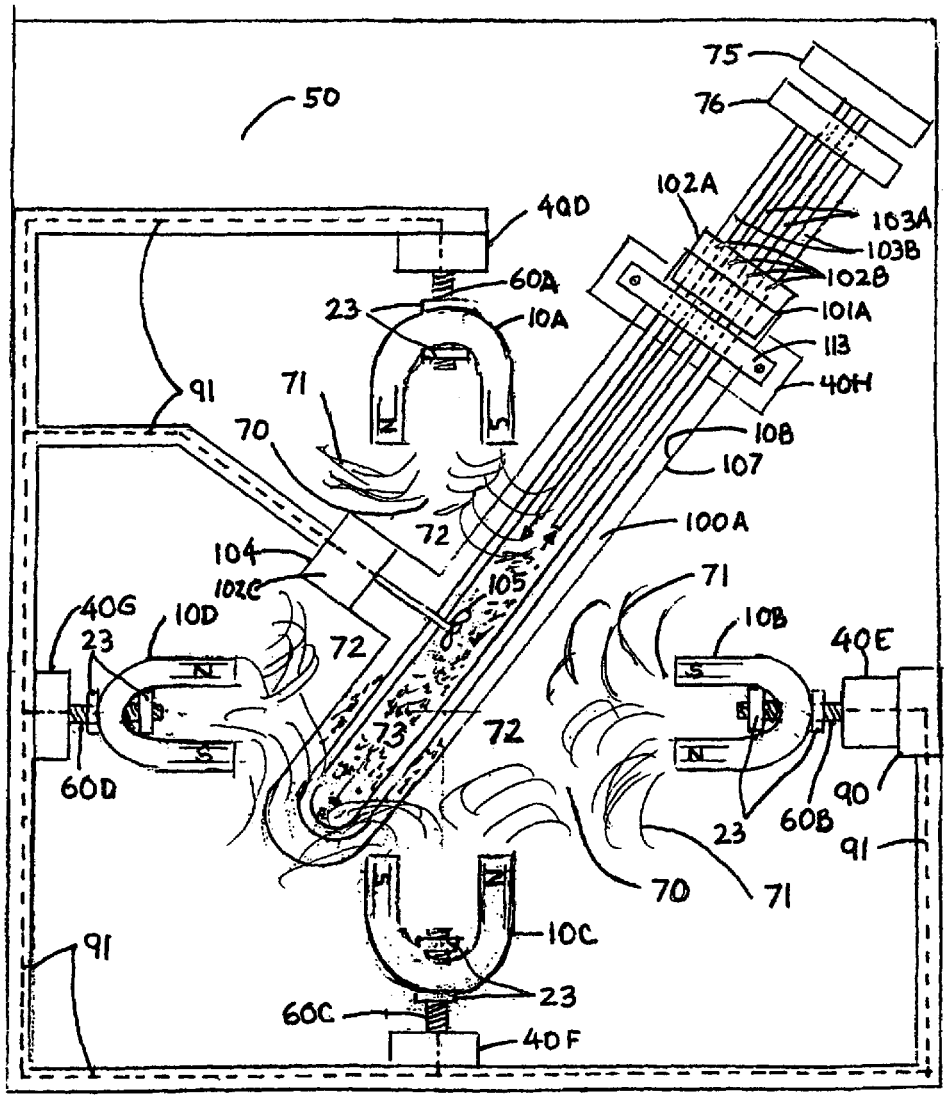
FIG. 12 is a top plan view of apparatus for processing material according to a second embodiment of the invention.
Figure 13:
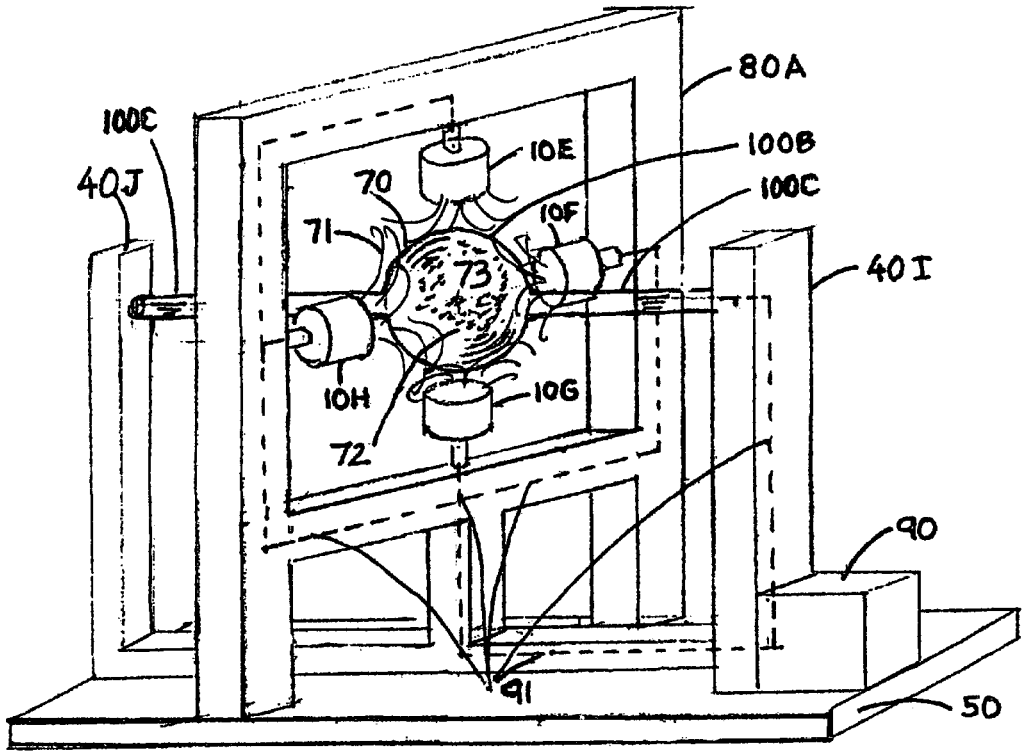
FIG. 13 is an isometric view of apparatus for processing material according to a third embodiment of the invention.

The position of magnet 10C in relation to vertical support 40C is adjustable by the location of the corresponding holding nuts 23 along the threaded end 25 of transverse axle 60. The unthreaded end of transverse axle 60 extends an appropriate distance beyond vertical support 40C with a 90° bend 26A and a second 90° bend 26B in a direction away from the position of magnet 10C and parallel to transverse axle 60 to form an offset crank handle 26 parallel to transverse axle 60 to rotate magnet 10C. Alternatively, transverse axle 60 can be rotated by a motor 90 as shown in FIGS. 12 and 13, for example. Vertical support 40C is fixedly attached to base support 50.

When crank handle 26 rotates transverse axle 60 and magnet 10C fixedly attached thereto the opposing magnetic lines of force 71 of the same magnetic polarity generate a magnetic vortex 72 in the space 70 constituting the material processing space in which the magnetic lines of force 71 act upon material 73 placed in the material containment vessel 100.

Because of the repelling force of the magnetic lines of force of the same magnetic polarity emanating from magnets 10A, 10B, and 10C, the repetitive turning of magnet 10C causes the magnetic lines of force 71 emanating from magnet 10C to repetitively rotatably drive magnets 10A and 10B synchronously around longitudinal axle 20 in repeated cycles of opposing magnetic lines of force. As a result, a complex spatially changing magnetic field traverses an essentially spherical space to continuously maintain the magnetic vortex 72 in material processing space 70. The alignment of transverse axle 60 between 70° and 85° relative to the perpendicular to longitudinal axle 20 produces the desired driving force to synchronously rotate magnets 10A and 10B whereas experiment shows a considerable less driving force if transverse axle 60 is perpendicular to longitudinal axle 20 since the opposing magnetic lines of force 71 would essentially be in equilibrium.

The material containment vessel 100 is positioned so that its interior communicates with the material processing space 70 in which the magnetic lines of force 71 constituting the opposing magnetic fields of the three magnets interact with each other to form the magnetic vortex 72.

Material containment vessel 100 is preferably fabricated with an orifice 101 through which material generally 73 is introduced into and evacuated from the vessel cavity 74. Orifice 101 is fitted with a suitably sized closure means 102. Vessel 100 is adjustably mounted to a bracket 110 by clamp 112 and holding screw 111A, which bracket in turn is adjustably mounted to vertical support 40B by adjusting screw 111B. Vertical supports 40A, 40B, 40C and base support 50 are preferably fabricated from nonmagnetic materials of sufficient length, size, and strength to support magnets 10A, 10B, and 10C and material containment vessel 100 and so positioned in relation to the size of material containment vessel 100 so as to permit free rotation of magnets 10A and 10B on longitudinal axle 20 and magnet 10C on transverse axle 60 and crank handle 26 in relation to base support 50.

Other means of mounting longitudinal axle 20 and transverse axle 60 to vertical supports 40A, 40B, and 40C may be utilized, including various types of bushings, ball bearing or needle bearing assemblies inserted into or externally mounted on vertical supports 40A, 40B, and 40C with brackets and supports familiar to those skilled in the fabrication arts.

Figure 10:
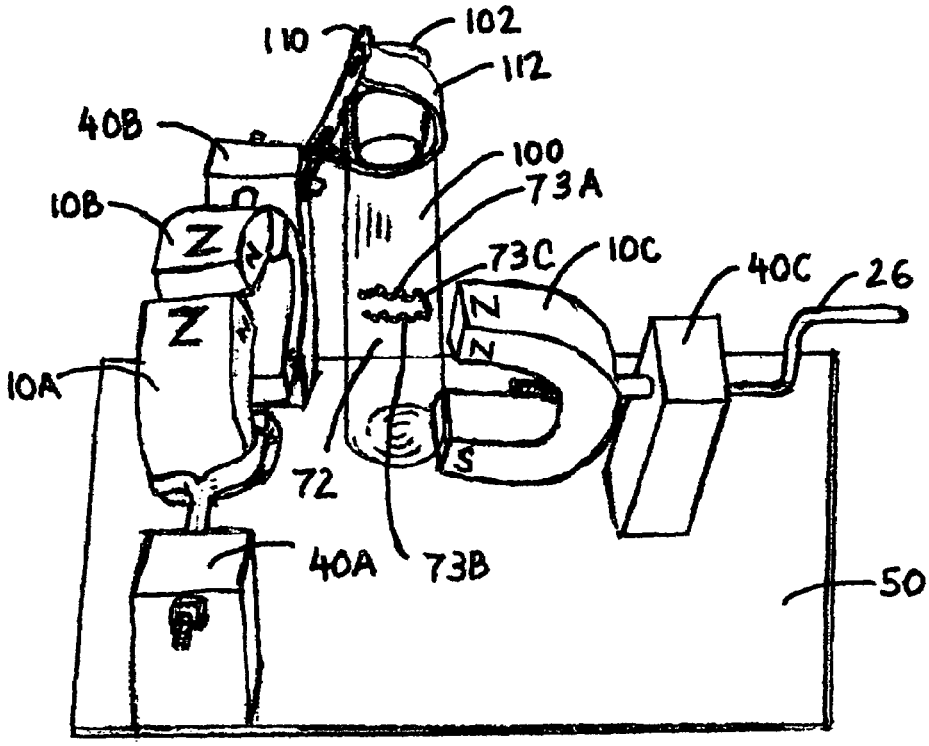
FIG. 10 is an isometric view of the apparatus shown in FIG. 9 more distinctly showing material that has been processed into two separated helices with connecting material between the two helices and levitated within the material containment vessel.

As seen in FIG. 10, material 73 has been processed by interaction with the magnetic vortex 72 by being separated into two distinct helical strands 73A and 73B akin to the long-chain helices associated with the strands of the DNA molecule and aligned lengthwise across magnetic vortex 72. A connecting strand of material 73C joins helical strands 73A and 73B. These strands may be preserved in those shapes for various purposes, as for example, but without necessary limitation, by introducing various liquids or thermoplastic materials into the material containment vessel that will attach to material 73 during the processing of the material and provide an adhesive film to material 73 such that when the temperature and pressure within material containment vessel 100 is lowered to a desired point and material 73 is removed, the liquid or thermoplastic material will have hardened sufficiently to maintain the material in the desired shape. Additionally, as material 73 can be levitated in situ for a substantial period of time by stopping the rotation of magnets 10A, 10B, and 10C, material 73 can be subjected to various types of analysis such as is done in crystallography and associated instrumental analysis in a gravity-free or micro-gravity environment.

Figure 11:
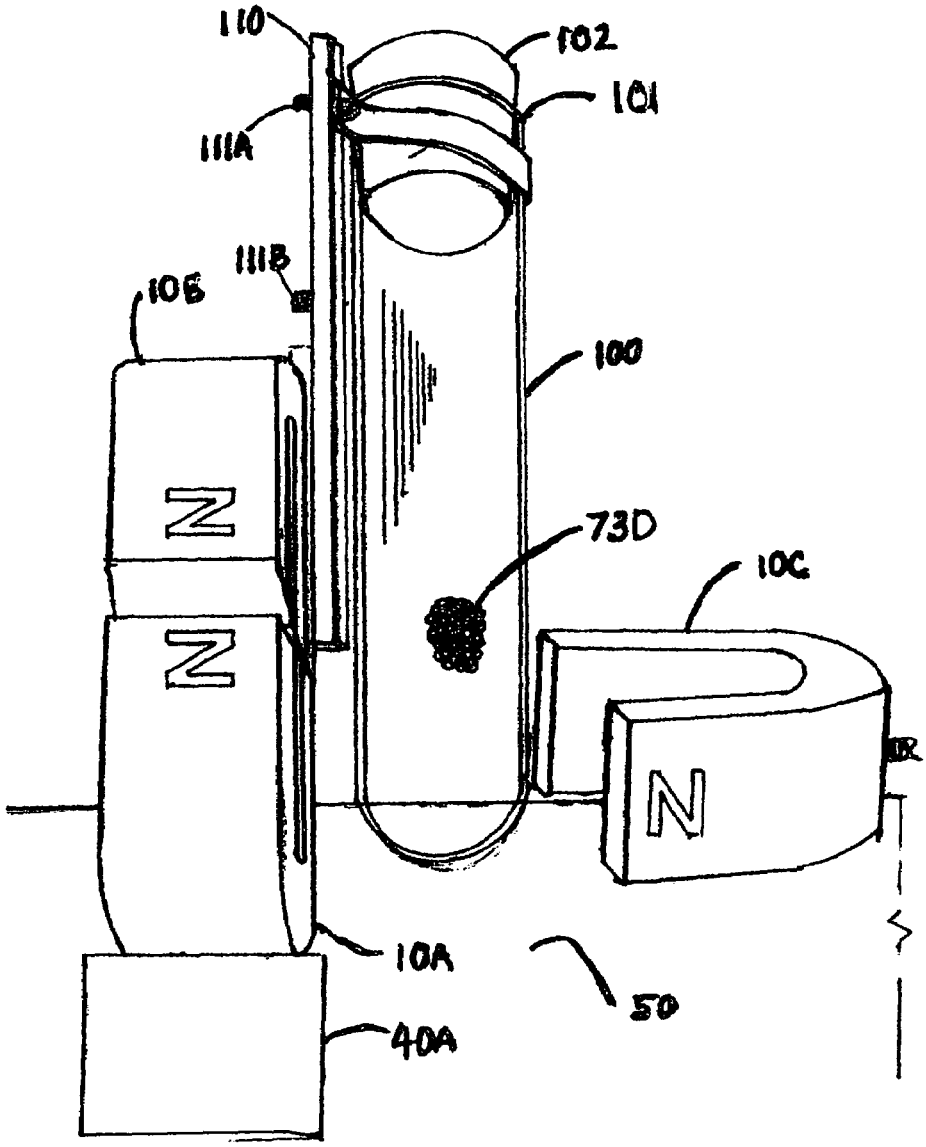
FIG. 11 is a simplified isometric close-up view of the apparatus in FIG. 9 showing material that has been processed into an essentially spherical shape and levitated within the material containment vessel.

FIG. 11 is a simplified close-up top plan view of magnets 10A, 10B, and 10C and material containment vessel 100 in which the material 73 has been sufficiently processed such that the helical strands 73A and 73B and connecting strand 73C have convoluted upon themselves and become aggregated so as to form an essentially compacted spherical mass 73D in the material containment vessel 100. By stopping the rotation of magnets 10A, 10B, and 10C at a position such that the magnetic lines of force in opolarity are in essential equipoise the material 73D is levitated within containment vessel 100.

In FIG. 12 four horseshoe magnets 10A, 10B, 10C, and 10D are fixedly mounted on four individual rotatable transverse axles 60A, 60B, 60C, and 60D respectively attached to vertical supports 40D, 40E, 40F, and 40G in order to generate a magnetic vortex 72 of sufficient size to accommodate a larger material containment vessel 100A. Vertical supports 40D, 40E, 40F, and 40G are rigidly attached to base 50. Material containment vessel 100A is fabricated with an orifice 101A fitted with a closure means 102A that has been fabricated with orifices 102B and tubes 103A through which material can be added to and removed from a material reservoir 75 and tubes 103B by which the temperature, pressure, and electrical properties within the material containment vessel 100A can be changed by associated physical conditioning equipment 76. Material containment vessel 100B is mounted on its own individual support 40H by bracket 113 and rigidly attached to base 50.

Controllable coordinated rotation of magnets 10A, 10B, 10C, and 10D is accomplished by a drive motor 90 that is operatively connected by transmission linkages 91 to rotatable transverse axles 60A, 60B, 60C, and 60D so as to maintain continuous opolarity in the magnetic vortex 72.

Material containment vessel 100A also has a second orifice 104 and closure means 102C for the introduction of apparatus such as, but without limitation, a stirrer 105 for stirring the material 73 within vessel 100A, which stirrer is operatively connected by transmission linkages 91 to drive motor 90.

Material containment vessel 100A can be fabricated with externally mounted tubes through which liquids, gases, or electrical heating coils are made to pass so as to change the temperature within the vessel by thermal conductivity between the external surface 107 and internal surface 108 of material containment vessel 100A, operative communication with physical conditioning equipment 76, and by microwave and radio-frequency induction heating methods.

In FIG. 13 four electromagnets 10E, 10F, 10G, and 10H are rotatably mounted to a peripheral support structure 80A similar to that shown as 80 in FIGS. 7 and 8, which peripheral support structure is oriented in an essentially vertical position. A generally spherical rotatable material containment vessel 100B is supported by a rotatable horizontal shaft 100C the ends of which shaft are rotatably mounted to and supported by vertical supports 40I and 40J fixedly attached to base support 50. A motor 90 drives associated transmission linkages 91 that are fabricated to peripheral support structure 80A and vertical support 40I to controllably coordinately rotate magnets 10E, 10F, 10G, and 10H and material containment vessel 100B. The rotation of magnets 10E, 10F, 10G, and 10H is synchronized by transmission linkages 91 so that the north pole of every magnet is continuously in juxtaposition with the north pole of an adjacent magnet and at the same given time the south pole of every magnet is in juxtaposition with the south pole of an adjacent magnet so as to maintain a continuous magnetic vortex 72 into which material containment vessel 100B is placed.

Material containment vessels 100, 100A, and 100B are preferably fabricated from materials that do not adversely interfere with the transmission of the magnetic lines of force 71 through the surface of the vessels and thereby adversely affect the processing of the material by the magnetic vortex.

A variety of applications of the apparatus and methods described above are illustrated by the following examples:

EXAMPLE 1

As shown in FIG. 9, a glass test tube constituting a material containment vessel 100 contains about two dozen miniature ball bearings 73 of magnetic material, which tube is positioned so that it traverses the material processing space 70. The orifice 101 of glass test tube 100 is sealed with a rubber or cork stopper 102. A magnet 10C is fixedly attached to a transverse axle 60 which axle has been fabricated into an integrated crank handle 26 such that when the crank handle 26 is rotated magnetic 10C is rotated so as to project magnetic lines of force 71 toward two other magnets 10A and 10B and their respective magnetic lines of force such that magnet 10C repeatedly rotatably drives magnets 10A and 10B around a longitudinal axle 20 upon which magnets 10A and 10B have been mounted. Magnets 10A and 10B are held in a fixed relationship of opposing magnetic lines of force by a tubular sleeve 30 the ends of which have been flattened into opposing tabs 31A and 31B. The magnetic lines of force of magnets 10A, 10B, and 10C are focused to space 70 such that upon repeated coordinated rotation they generate and maintain a magnetic vortex 72 into which material containment vessel 100 and material 73 therein have been positioned. As a result, the ball bearings 73 are subjected to repeated continuous cycles of being compacted, aggregated, separated, reaggregated, manipulated, tumbled, and levitated in the material containment vessel 100. In the process, the magnetic vortex 72 causes the ball bearings 73 to form repeated series of helices and also induces magnetic properties into the ball bearings.

By fabricating the material containment vessel out of more sturdy material to which associated equipment can be operatively connected the temperature, pressure, and electrical properties within the material containment vessel can be changed. By providing additional orifices through which more ball bearings can be added and from which processed ball bearings can be removed and through which orifices means to stir and agitate the ball bearings can be introduced, the ball bearings can be coated with a suitable temperature sensitive adhesive such as granules of a thermoplastic material that becomes liquid at a designated temperature and solidifies as it cools. The coated ball bearings can be controllably added to the tube along with additional supplies of the thermoplastic material and at the same time suitably coated and configured ball bearings can be removed at designated locations of the material containment vessel at a lower temperature such that the process can be continuous over a period of time. Another method is to process the material in discrete batches.

Because of the close proximity of the coated ball bearings to each other they will have special electrical conductivity properties as to each other individually and in the aggregate that are distinct from either a continuous solid piece of material or discrete entities that touch only at a single point on their external spherical surfaces.

The invention contemplates that like results are achievable with materials that are paramagnetic and materials that can be made susceptible to the effects of magnetic lines of force to induce particular electrical properties into the individual elements of the material so as to obtain new and desired physical, chemical, and electrical properties not otherwise inherent in the individual materials themselves.

The process of the present invention has particular significance for such industries as those that produce semiconductor materials whose properties depend on the uniform distribution of desired trace elements, the metallurgical industries that produce alloys having specifically desired properties predicated on the uniform distribution of alloying materials such as chromium, molybdenum, and titanium, the crystal growing industry, and the pharmaceutical industry.

EXAMPLE 2

FIG. 11 shows another characteristic result of processing the material in the preferred embodiment in which the ball bearings 73D have been aggregated and compacted into an essentially spherical shape during the separating, reaggregating, manipulating, tumbling, and levitating action by the magnetic vortex. During these operations the ball bearings are continuously intermixed so that over a period of processing time they become essentially uniformly intermixed. In conjunction with the processing operation of Example 1 such processing of the material 73D comprises a homogenization process to uniformly distribute the ball bearings within the aggregated mass.

EXAMPLE 3

The relationship between electricity and magnetism has been known since the earliest discoveries of Oersted and Faraday and forms the basis of the electromechanical arts and particularly that of rotating apparatus. Subsequent discoveries by Faraday revealed the electrolytic properties of liquids and in conjunction with the discoveries of Galvani and Volta provided the basic principles underlying the electrochemical arts. The work of Planck, Einstein, DeBroglie, Schrödinger and others revealed the quantum and wave mechanical properties associated with the electromagnetic field propagated by the nucleus and surrounding orbital electrons, both of which could be directly affected by surrounding magnetic fields.

Another use of the invention contemplates introducing organometallic substances into a material containment vessel and conditioning the material by controlled changes in temperature, pressure, and electrical conductivity so as to make the material electrolytically active and therefore amenable to the effects of the magnetic lines of force generated by associated magnets thereby altering the position of the electrons in their respective orbital shells to change the physical and chemical properties of the material and its chemical composition. When the temperature, pressure, and electrical properties are controllably changed to a desired condition, the material is evacuated from the material containment vessel and retains its new physical and chemical properties and chemical composition. The invention contemplates that the processing of such organometallic materials can be achieved in batches that are sealed into the mass containment vessel or with associated equipment to process the material as a continuous process.

EXAMPLE 4

Another objective of the invention is to process wholly organic materials that can be made electrochemically active by dissociation of the chemical bonds between the constituent elements in the organic compound and so make the material ionized or electrolytic such that the chemical properties dependent upon the location of the electrons in their orbital shells can be controllably altered to change the physical and chemical properties and chemical composition of the material when it is removed from the material containment vessel.

EXAMPLE 5

The invention also contemplates the introduction of other materials such as, but without necessary limitations, ions and free radicals that are released by substances under predetermined conditions of temperature, pressure, and electrical conductivity such that when the primary material is subjected to the desired temperature, pressure, and electrical conductivity properties within the material containment vessel the ions, free radicals and other active materials attach themselves to designated locations on the primary material under the quantum and wave mechanical effects of the compacting, aggregating, separating, reaggregating, manipulating, tumbling, and levitating effects of the magnetic vortex.

The ability to attach specific ions, free radicals, and other physically and/or chemically active substances to particular sites of a primary material is especially significant to the pharmaceutical industry where such materials have particular medical significance as well as to the semiconductor industry where trace elements attached to a primary material have desired electrical properties.

EXAMPLE 6

Another objective of the invention is to study and process materials in what is essentially a gravity-free or micro-gravity environment within the magnetic vortex akin to that which exists in a nonterrestrial environment.

The invention contemplates that the magnetic fields generated by the magnets are individually adjustable to continuously levitate the material in the material containment vessel while the material is undergoing the desired processing operations. Conditions such as these would permit the processing and studying of materials in a terrestrial environment that can only otherwise be done currently at exorbitant cost and with exceedingly limited available resources in nonterrestrial environments such as orbiting space shuttles and space labs.

The invention embraces other configurations of magnets capable of generating magnetic vortices and material containment vessels positioned so that material therein interacts with the magnetic vortex. For example, a material containment vessel such as that shown in FIG. 13 as 100B can be aligned in a vertical rather than a horizontal orientation with an orientation to a peripheral support structure such as 80A with a coaxial relationship with the vertical material containment vessel such that they coordinately rotate in relationship to each other rather than one being fixed and the other rotating.

The invention also contemplates various configurations by which the material containment vessel can be mounted on a support structure that is operatively connected with apparatus capable of various types of movements that will circulate or agitate the material within the material containment vessel.

Other configurations of a magnetic vortex, other configurations of supports and associated apparatus and equipment may be utilized following the teachings of the present invention as will be apparent to those skilled in the art without departing from the scope therein.

I claim:

1. Apparatus for processing material in a rotating magnetic field, said apparatus comprising:

a base;

a support structure operatively connected to said base;

a magnetic field generating means operatively connected to said support structure for generating a rotating magnetic field configuration concentrated in a generally central spherical space, the orientation of said rotating magnetic field configuration being such that material within said generally central spherical space is repulsed toward the center thereof, further comprising a plurality of magnetic field generating elements rotatably mounted to said support structure, each magnetic field generating element having a north pole and a south pole, said north pole and said south pole of each magnetic field generating element having a tendency to repel each like said north pole and said south pole of each other magnetic field generating element respectively upon coordinated synchronous rotation, said magnetic field generating elements being disposed in spatial relationship with each other so that said north pole of each magnetic field generating element remains in relative repelling spatial relationship to said north pole of another magnetic field generating element and said south pole of each magnetic field generating element remains in relative repelling spatial relationship to said south pole of another magnetic field generating element and when said magnetic field generating elements are coordinately synchronously rotated with respect to each other said north poles and said south poles remain in relative repelling spatial relationship to each other to generate generally co-planar ring-shaped magnetic field configurations, each of said configurations rotating about an axis, said configurations converging at a common locus in said generally central spherical space to generate a repetitive generally spherical shell-like space of revolving magnetic lines of force constituting a magnetic vortex;

a material containment vessel operatively connected to said support structure having at least a material processing portion thereof disposed in said magnetic vortex and extending adjacent to the center thereof; and a magnetic field movement means operatively connected to said support structure and said magnetic field generating elements for causing relative coordinated synchronous repetitive rotatable movement of said magnetic field generating elements with respect to said material processing portion of said material containment vessel whereby said magnetic vortex induces quantum and wave mechanical and magnetic effects into said material so as to change the physical, chemical, and magnetic properties and chemical composition of said material and to cause said material to be compacted, aggregated, separated, reaggregated, manipulated, tumbled, levitated, and processed in said material containment vessel.

2. The apparatus according to claim 1 wherein said support structure comprises individual means to support said rotatable magnetic field generating elements and said material containment vessel.

3. The apparatus according to claim 1 wherein said magnetic field generating elements are permanent magnets.

4. The apparatus according to claim 1 wherein the magnetic field intensity of said magnetic field configuration is adjustable so that said magnetic field intensity is approximately uniform at given distances from the center of said generally spherical space constituting said magnetic vortex.

5. The apparatus according to claim 1 wherein said material containment vessel is fabricated with orifices and closure means to said orifices through which material can be added to and removed from said material containment vessel in operative connection with a material reservoir means and through which moveable equipment for agitating and stirring said material can be introduced and through which means to adjust the temperature, pressure, and electrical properties within said material containment vessel by physical conditioning means in operative communication with said material containment vessel.

6. The apparatus according to claim 1 wherein said material containment vessel is moveably connected to said support structure so as to circulate or agitate said material in said material containment vessel.

7. The apparatus according to claim 1 wherein said external surface of said material containment vessel is fabricated with means to change the internal temperature of said material containment vessel by conductive, microwave, and radiant energy through the external and internal surfaces of said material containment vessel.

8. The apparatus according to claim 1 wherein said material containment vessel is fabricated of material that does not adversely interfere with the transmission of magnetic lines of force through the surface of said material containment vessel.

9. The apparatus according to claim 1 wherein said rotation of said magnetic field generating elements is accomplished by a crank handle and associated tubular sleeves.

10. The apparatus according to claim 1 wherein said rotation of said magnetic field generating elements is accomplished by a motor and associated transmission linkages.

11. The apparatus according to claim 1 wherein said support structure comprises a peripheral support structure to which said rotatable magnetic field generating elements and said material containment vessel are rotatably mounted.

12. The apparatus according to claim 11 wherein said peripheral support structure and said rotatable magnetic field generating elements and said material containment vessel are rotatably mounted in relationship to said base.

13. The apparatus according to claim 12 wherein said rotation of said magnetic field generating elements and said material containment vessel and said peripheral support structure is accomplished by a motor and associated transmission linkages.

14. The apparatus according to claim 1 wherein said magnetic field generating elements are electromagnets.

15. The apparatus according to claim 14 wherein the magnetic field intensity of said electromagnets are individually adjustable.

16. Apparatus for processing material by opposing magnetic lines of force of the same magnetic polarity constituting a magnetic vortex, said apparatus comprising:

a base;

a support structure operatively connected to said base;

a material containment vessel operatively connected to said support structure and having a plurality of orifices and closure means to said orifices through which material can be added to and removed from said material containment vessel from a material reservoir means in operative connection to said material containment vessel and through which equipment for agitating and stirring said material can be introduced and through which means the temperature, pressure, and electrical properties within said material containment vessel can be changed by physical conditioning means in operative communication with said material containment vessel and a material processing portion therein;

a magnetic field rotation means operatively connected to said support structure for synchronously rotating magnetic field generating means;

said rotating magnetic field generating means operatively connected to said support structure further comprising a plurality of magnetic field generating elements rotatably mounted to said support structure, each magnetic field generating element having a north pole and a south pole, said north pole and said south pole of each magnetic field generating element having a tendency to repel said like north pole and said south pole of each other magnetic field generating element, said magnetic field generating elements being disposed in spatial relationship with each other so that said north pole of each magnetic field generating element remains in relative repelling spatial relationship to said like north pole of each other magnetic field generating element and said south pole of each magnetic field generating element remains in relative repelling spatial relationship to said like south pole of each other magnetic field generating element and when said magnetic field generating elements are coordinately synchronously rotated with respect to each other said north poles and said south poles remain in relative repelling spatial relationship to each other to generate generally co-planar ring-shaped magnetic field configurations each of said configurations rotating about an axis, said configurations focused to converge to a common locus in a generally central space to generate a repetitive generally spherical shell-like space of revolving magnetic lines of force operatively associated with said support structure and concentrated in said generally central spherical shell-like space to constitute a magnetic vortex, the orientation of said field configuration being such that material placed in said material processing portion of said material containment vessel placed within said magnetic vortex is compacted, aggregated, separated, reaggregated, manipulated, tumbled, levitated, processed and subjected to the quantum and wave mechanical and magnetic effects of said magnetic vortex so as to change the physical, chemical, and magnetic properties and chemical composition of said material.

17. The apparatus according to claim 16 wherein said magnetic field generating elements are permanent magnets.

18. The apparatus according to claim 16 wherein said external surface of said material containment vessel is fabricated with means to change the internal temperature of said material containment vessel by conductive, microwave, and radiant energy through the external and internal surfaces of said material containment vessel.

19. The apparatus according to claim 16 wherein said material containment vessel is fabricated of material that does not adversely interfere with the transmission of magnetic lines of force through the surface of said material containment vessel.

20. The apparatus according to claim 16 wherein said material containment vessel is moveably connected to said support structure so as to circulate or agitate said material in said material containment vessel.

21. The apparatus according to claim 16 wherein said rotation of said magnetic field generating elements is accomplished by a crank handle and associated tubular sleeves.

22. The apparatus according to claim 16 wherein said rotation of said magnetic field generating elements is accomplished by a motor and associated transmission linkages.

23. The apparatus according to claim 16 wherein said support structure comprises a peripheral support structure to which said magnetic field generating elements and said material containment vessel are rotatably mounted.

24. The apparatus according to claim 23 wherein said peripheral support structure is coordinately rotatable in association with the rotation of said magnetic field generating elements and rotation of said material containment vessel in relation to said base.

25. The apparatus according to claim 24 wherein said rotation of said magnetic field generating elements and said material containment vessel and said peripheral support structure is accomplished by a motor and associated transmission linkages.

26. The apparatus according to claim 16 wherein said magnetic field generating elements are electromagnets.

27. The apparatus according to claim 26 wherein the magnetic field intensity of said electromagnets is individually adjustable so that said magnetic field intensity is approximately uniform at given distances from the center of said generally central spherical shell-like space constituting said magnetic vortex.

28. Apparatus for compacting, aggregating, separating, reaggregating, manipulating, tumbling, levitating, and processing material in a magnetic vortex, comprising:

a base;

a support structure operatively connected to said base;

a first magnetic field generating element having a magnetic north pole and south pole rotatably mounted to said support structure for generating a first magnetic field configuration extending into a generally central spherical shell-like space;

a second magnetic field generating element having a like magnetic north pole and south pole rotatably mounted to said support structure for generating a second magnetic field configuration extending into said generally central spherical shell-like space in spaced relationship to said first magnetic field generating element such that said respective north poles and said south poles tend to repel each other;

a third magnetic field generating element having a like magnetic north pole and south pole rotatably mounted to said support structure for generating a third magnetic field configuration extending into said generally central spherical shell-like space in spaced relationship to said first magnetic field generating element and said second magnetic field generating element such that said respective north poles and said south poles tend to repel each other;

which respective said first magnetic field generating element and said second magnetic field generating element and said third magnetic field generating element upon coordinated synchronous rotation remain in continuous relative repelling spatial relationship to each other such that said respective north pole of each said magnetic field generating element remains in continuous relative repelling spatial relationship to said like north pole of each other said magnetic field generating element and said south pole of each said magnetic field generating element remains in continuous relative repelling spatial relationship to each other like said south pole to generate generally co-planar ring-shaped magnetic field configurations rotating about their respective axis such that when said configurations are focused to converge to a common locus in a generally central space they generate a repetitive generally spherical shell-like space of revolving magnetic lines of force constituting said magnetic vortex of opposing magnetic lines of force of the same magnetic polarity in said generally central spherical shell-like space such that the orientation of said magnetic vortex in relation to said material is to repulse said material toward the generally center of said magnetic vortex;

a material containment vessel mounted to said support structure having a material processing portion therein traversing said magnetic vortex and having orifices and closure means to said orifices through which said material can be added to and removed from said material containment vessel in operative connection to a material reservoir means and through which moveable equipment can be introduced to stir and agitate said material and through which means to change the temperature, pressure, and electrical properties within said material containment vessel can be introduced; and means for coordinately synchronously rotating said first magnetic field generating element, said second magnetic field generating element, and said third magnetic field generating element to generate said magnetic vortex;

whereby said material is continuously acted upon by the quantum and wave mechanical and magnetic effects of said magnetic vortex so as to change the physical, chemical, and magnetic properties and chemical composition of said material.

29. The apparatus according to claim 28 wherein said support structure comprises individual means to support said first magnetic field generating element and said second magnetic field generating element and said third magnetic field generating element and said material containment vessel.

30. The apparatus according to claim 28 wherein said first magnetic field generating element and said second magnetic field generating element and said third magnetic field generating element are permanent magnets.

31. The apparatus according to claim 28 wherein the magnetic field intensity of said magnetic field configurations is adjustable such that said magnetic field intensity is approximately uniform at given distances from said magnetic vortex.

32. The apparatus according to claim 28 wherein said material containment vessel is fabricated of material that does not adversely interfere with the transmission of magnetic lines of force through the surface of said material containment vessel.

33. The apparatus according to claim 28 wherein said material containment vessel is fabricated with external means to change the temperature within said material containment vessel by conductivity through the internal and external surfaces of said material containment vessel.

34. The apparatus according to claim 28 wherein said material containment vessel is moveably connected to said support structure so as to circulate or agitate said material in said material containment vessel.

35. The apparatus according to claim 28 wherein said rotation of said first magnetic field generating element, said second magnetic field generating element, and said third magnetic field generating element is accomplished by a crank handle and associated tubular sleeves.

36. The apparatus according to claim 28 wherein said first magnetic field generating element and said second magnetic field generating element and said third magnetic field generating element are electromagnets.

37. The apparatus according to claim 36 wherein the magnetic field intensity of said electromagnets is individually adjustable.

38. The apparatus according to claim 28 wherein said support structure comprises a peripheral support structure to which said first magnetic field generating element and said second magnetic field generating element and said third magnetic field generating element and said material containment vessel are rotatably mounted.

39. The apparatus according to claim 38 wherein said peripheral support structure is coordinately rotatable in association with the rotation of said first magnetic field generating element and said second magnetic field generating element and said third magnetic field generating element and said material containment vessel in relation to said base.

40. The apparatus according to claim 39 wherein said rotation of said first magnetic field generating element and said second magnetic field generating element and said third magnetic field generating element and said rotatable peripheral support structure and said material containment vessel is accomplished by a motor and associated transmission linkages.

41. A method for processing material in a material containment vessel by rotating opposing magnetic lines of force of the same magnetic polarity constituting a magnetic vortex comprising the steps of:

generating a revolving magnetic field configuration of opposing magnetic lines of force of the same magnetic polarity that has been focused to converge to and be concentrated in a generally central spherical shell-like space so as to generate a magnetic vortex;

placing said material in a material processing portion of said material containment vessel and positioning said material processing portion within said magnetic vortex;

controlling the temperature, pressure, and electrical properties within said material processing portion of said material containment vessel so as to make said material susceptible to the quantum and wave mechanical and magnetic effects of said magnetic vortex whereby said material is compacted, aggregated, separated, reaggregated, manipulated, tumbled, and levitated in said material containment vessel and said quantum and wave mechanical and magnetic effects of said magnetic vortex change the physical, chemical, and magnetic properties and chemical composition of said material.

42. The method of claim 41 wherein said material is introduced into and evacuated from said material containment vessel so as to maintain continuous processing of said material.

43. The method of claim 41 wherein said material is selected from the group consisting of magnetic materials and materials that can be made susceptible to the effects of a magnetic field.

44. A method for compacting, aggregating, separating, reaggregating, manipulating, tumbling, and levitating magnetic materials and materials that can be made susceptible to the effects of a magnetic field of rotating opposing magnetic lines of force of the same magnetic polarity constituting a magnetic vortex comprising the steps of:

generating a magnetic vortex by positioning a rotatable first magnetic field generating element having a north pole and a south pole operatively connected to a support structure and focused to a generally central spherical shell-like space;

positioning a rotatable second magnetic field generating element having a like north pole and south pole operatively connected to a support structure placed in spaced relationship to said rotatable first magnetic field generating element, said north poles and said south poles of said rotatable first magnetic field generating element and said like rotatable second magnetic field generating element remaining in relative spatial relationship to each other such that said like north poles and said south poles continuously have a tendency to repel each other;

positioning a rotatable third magnetic field generating element having a like north pole and south pole in a support structure in spaced relationship to said rotatable first magnetic field generating element and said second magnetic field generating element such that the said north poles and said south poles of said rotatable first magnetic field generating element and said rotatable second magnetic field generating element and said rotatable third magnetic field generating element remain in continuous relative repelling spatial relationship to each other during said rotation when focused to converge to a generally central spherical space;

coordinately synchronously rotating said rotatable first magnetic field generating element and said rotatable second magnetic field generating element and said rotatable third magnetic field generating element such that upon rotation said magnetic lines of force in repelling spatial relationship to each other generate a continuously revolving generally central spherical shell-like space of opposing magnetic lines of force of the same polarity constituting a magnetic vortex;

positioning said material in a material containment vessel having a processing portion therein in said magnetic vortex whereby said material is repetitively acted upon by the quantum and wave mechanical and magnetic effects of said magnetic vortex so as to change the physical, chemical, and magnetic properties and chemical composition of said material.

45. The method of claim 44 wherein said material is introduced into and evacuated from said material containment vessel so as to maintain continuous processing of said material.

46. A method for processing magnetic materials and materials that can be made susceptible to the effects of a magnetic vortex comprising the steps of:

continuously synchronously rotating three or more permanent or electromagnets each having a north pole and a south pole focused to a generally central spherical shell-like space at which their respective magnetic lines of force of the same magnetic polarity remain in continuous relative repelling spatial relationship to each other so as to generate said magnetic vortex in said generally central spherical shell-like space;

placing said material in a material processing portion of a material containment vessel and placing said material processing portion of said material containment vessel in said magnetic vortex;

controlling the temperature, pressure, and electrical properties within said material containment vessel so as to make said material susceptible to the quantum and wave mechanical and magnetic effects of said magnetic vortex to change the physical, chemical, and magnetic properties and chemical composition of said material and to compact, aggregate, separate, reaggregate, manipulate, tumble, and levitate said material in said material containment vessel.

47. The method of claim 46 wherein said material is introduced into and evacuated from said material containment vessel so as to maintain continuous processing of said material.

* * * * *